US006878854B2

(12) United States Patent
O'Rear

(10) Patent No.: US 6,878,854 B2
(45) Date of Patent: Apr. 12, 2005

(54) TEMPORARY ANTIOXIDANTS FOR FISCHER-TROPSCH PRODUCTS

(75) Inventor: Dennis J. O'Rear, Petaluma, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 228 days.

(21) Appl. No.: 09/882,675

(22) Filed: Jun. 15, 2001

(65) Prior Publication Data

US 2002/0193645 A1 Dec. 19, 2002

(51) Int. Cl.[7] ..... C10M 135/22; C07C 7/20

(52) U.S. Cl. ..... 585/1; 585/16; 508/569; 518/700; 518/728

(58) Field of Search ..... 508/569; 585/1, 585/16; 518/700, 728

(56) References Cited

U.S. PATENT DOCUMENTS

| | | | |
|---|---|---|---|
| 2,718,501 | A | 9/1955 | Harle |
| 4,148,739 | A | 4/1979 | Liston et al. |
| 4,568,663 | A | 2/1986 | Mauldin |
| 5,344,577 | A | 9/1994 | Deckman et al. |
| 5,453,211 | A | 9/1995 | Alward |
| 5,880,279 | A | 3/1999 | Mazgarov et al. |
| 6,103,099 | A | 8/2000 | Wittenbrink et al. |
| 6,369,286 | B1 | 4/2002 | O'Rear |
| 6,392,108 | B1 | 5/2002 | O'Rear |
| 6,392,109 | B1 | 5/2002 | O'Rear et al. |

FOREIGN PATENT DOCUMENTS

| | | |
|---|---|---|
| EP | 0609079 A1 | 8/1994 |
| EP | 0921184 A1 | 6/1999 |
| WO | 00/11116 | 3/2000 |
| WO | 00/11116 A1 | 3/2000 |
| WO | 00/11117 | 3/2000 |
| WO | 00/11117 A1 | 3/2000 |

OTHER PUBLICATIONS

Dutch Search Report dated Jan. 9, 2003.
Gruse, W.A. and Stevens, D.R., *Chemical Technology of Petroleum,* Third Edition, 1960, pp. 299–305, McGraw–Hill Book Company, Inc., New York.
Search Report dated Jan. 31, 2003.
Search Report from GB 0212724.9 dated Mar. 8, 2004.

*Primary Examiner*—Ellen M McAvoy
(74) *Attorney, Agent, or Firm*—Burns, Doane, Swecker & Mathis, L.L.P.

(57) ABSTRACT

The present invention relates to the use of antioxidants in Fischer Tropsch derived products. The antioxidants of the present invention are preferably temporary antioxidants that may be removed after the period in which oxidation is expected by techniques such as simple distillation. The temporary antioxidants of the present invention are typically sulfur-containing compounds generated from sweetening light hydrocarbon streams.

22 Claims, No Drawings

TEMPORARY ANTIOXIDANTS FOR FISCHER-TROPSCH PRODUCTS

FIELD OF THE INVENTION

The present invention relates to the use of antioxidants in Fischer Tropsch derived products. The present invention also relates to methods of inhibiting oxidation in Fischer Tropsch derived products.

BACKGROUND OF THE INVENTION

The majority of combustible fuel used in the world today is derived from crude oil. There are several limitations to using crude oil as a fuel source. Crude oil is in limited supply; it includes aromatic compounds that may be harmful and irritating, and it contains sulfur and nitrogen-containing compounds that can adversely affect the environment, for example, by producing acid rain.

Combustible liquid fuels can also be prepared from natural gas. This preparation involves converting the natural gas, which is mostly methane, to synthesis gas, or syngas, which is a mixture of carbon monoxide and hydrogen. An advantage of using products prepared from syngas is that they do not contain nitrogen and sulfur and generally do not contain aromatic compounds. Accordingly, they have minimal health and environmental impact.

Fischer-Tropsch chemistry is typically used to convert the syngas to a product stream that includes combustible fuel, among other products. These Fischer Tropsch products have very low levels of sulfur, nitrogen, aromatics and cycloparaffins. The Fischer Tropsch derived fuels are considered "green fuels" and are desirable as environmentally friendly.

Although environmentally friendly, these Fischer Tropsch products tend to oxidize relatively rapidly when exposed to air. The rapid oxidation may be due to a lack natural anti-oxidants, such as sulfur compounds. Further, some of the products produced by the Fischer Tropsch process may be waxy, and these products are frequently are shipped at elevated temperature. Shipping at elevated temperatures increases the tendency of Fischer Tropsch products to oxidize.

Various methods have been proposed to protect Fischer Tropsch products from oxidation during shipping and storage. For example, Berlowitz and Simon of Exxon Research and Engineering Company describe in World Patent Application Nos. WO 00/11116A1 and WO 00/111117A1 the blending of a Fischer Tropsch derived diesel fuel with high boiling sulfur containing streams, derived from gas field condensate or hydrotreated streams. Using the approach of Berlowitz and Simon to prevent oxidation adds high-boiling, sulfur-containing compounds to the Fischer Tropsch diesel fuel. Therefore, the products of Berlowitz and Simon contain sulfur, which prevents their use as low-sulfur, environmentally friendly fuels. Another undesirable feature of the products of Berlowitz and Simon is that a significant portion of the sulfur in those products is in the form of mercaptans (RSH). Mercaptans are well known to cause corrosion. Therefore, when shipping or storing products treated according to Berlowitz and Simon, corrosion of the large storage vessels can be a problem. Corrosion damage may lead to the need for eventual replacement of the large, expensive vessels used to ship and store hydrocarbonaceous products.

Various other well-known antioxidants may be used with Fischer Tropsch diesel fuels to prevent oxidation. These well-known antioxidants may include phenolic compounds and diphenylamine compounds. However, these antioxidants can be expensive when used on a large scale and must be transported to the remote site where the Fischer Tropsch diesel fuel is made.

There is a need for appropriate antioxidants for Fischer Tropsch derived products that do not impart polluting sulfur, corrosive mercaptans, or other undesirable components to the final product, and antioxidants that do not require shipping to the remote site where the Fischer Tropsch products are made. There is a need for efficient and economical methods of inhibiting oxidation of Fischer Tropsch derived products.

SUMMARY OF THE INVENTION

One aspect of the present invention is a blended hydrocarbonaceous product comprising: a) a Fischer Tropsch derived product; and b) an effective amount of a temporary antioxidant such that the blended hydrocarbonaceous product has a final peroxide number of less than 5 ppm, preferably less than 3 ppm and most preferably less than 1 ppm after 7 days. The temporary antioxidant may be derived from a petroleum product. The temporary antioxidant may be selected from the group consisting of sulfides, disulfides, polysulfides, and mixtures thereof.

An additional aspect of the present invention is a blended hydrocarbonaceous product comprising: a) a Fischer Tropsch derived product; and b) a sulfur-containing, temporary antioxidant, wherein the sulfur content of the blended hydrocarbonaceous product is >1 ppm.

A further aspect of the present invention is a method of inhibiting oxidation of a Fischer Tropsch product comprising the steps of:

a) synthesizing a Fischer Tropsch product by a Fischer Tropsch process;

b) adding an effective amount of a temporary antioxidant to provide a product having a final peroxide number of less than 5 ppm, preferably less than 3 ppm and most preferably less than 1 ppm after 7 days;

c) blending the Fischer Tropsch product and the antioxidant to provide a blended product; and d) removing at least a portion of the antioxidant from the blended product after the period in which oxidation is to be prevented.

The temporary antioxidant may be derived from a petroleum product and this may be done at or near to the site where the Fischer Tropsch products are generated. The temporary antioxidant may be selected from the group consisting of sulfides, disulfides, polysulfides, and mixtures thereof. The temporary antioxidant may be removed by a variety of processes, including for example, simple distillation or stripping.

An additional aspect of the present invention is a method of inhibiting oxidation of a Fischer Tropsch product comprising the steps of:

a) synthesizing a Fischer Tropsch product by Fischer Tropsch process;

b) adding an effective amount of a sulfur-containing antioxidant to provide a product having a final peroxide number of less than 5 ppm, preferably less than 3 ppm and most preferably less than 1 ppm after 7 days;

c) blending the Fischer Tropsch product and the antioxidant to provide a blended product; and d) processing the blended product to remove at least a portion of the sulfur after the period in which oxidation is to be prevented.

The antioxidant may be a temporary antioxidant or may be an antioxidant that has about the same boiling range as the Fischer Tropsch product. The antioxidant may be selected from the group consisting of sulfides, disulfides, polysulfides, mercaptans, and the like, and mixtures thereof. The antioxidant in the method of the present invention may be a mercaptan because the method of the present invention includes the step of processing the blended product to remove at least a portion of the sulfur after the period in which oxidation is expected. Although the antioxidant may be a mercaptan, it is preferred that the antioxidant be a compound other than a mercaptan.

The step of processing the blended product to remove sulfur may involve a variety of processes, including for example, hydrotreating, hydrocracking, hydroisomerization, extraction, adsorption, and the like. The preferred methods are those involving processing with hydrogen (i.e., hydrotreating, hydrocracking, and hydroisomerization), with hydrotreating being the most preferred.

A further aspect of the present invention is a method of inhibiting oxidation of a Fischer Tropsch product comprising the steps of:

a) synthesizing a Fischer Tropsch product by Fischer Tropsch process;

b) adding an effective amount of a temporary antioxidant to the Fischer Tropsch product to provide a product containing between 1 ppm and 1 wt % temporary antioxidant, preferably between 10 ppm and 1000 ppm temporary antioxidant.

c) blending the Fischer Tropsch product and the antioxidant to provide a blended product; and d) removing at least a portion of the sulfur from the blended product after the period in which oxidation is to be prevented.

The temporary antioxidant may be derived from a petroleum product and this may be done at or near to the site where the Fischer Tropsch products are generated. The temporary antioxidant may be selected from the group consisting of sulfides, disulfides, polysulfides, and mixtures thereof. The temporary antioxidant may be removed by a variety of processes, including for example, simple distillation or stripping.

Definitions:

Unless otherwise stated, the following terms used in the specification and claims have the meanings given below:

"Antioxidant" means any chemical compound that reduces the tendency of fuels to deteriorate by inhibiting oxidation.

"Branching index" means a numerical index for measuring the average number of side chains attached to a main chain of a compound. For example, a compound that has a branching index of two means a compound having a straight chain main chain with an average of approximately two side chains attached thereto. The branching index of a product of the present invention may be determined as follows. The total number of carbon atoms per molecule is determined. A preferred method for making this determination is to estimate the total number of carbon atoms from the molecular weight. A preferred method for determining the molecular weight is Vapor Pressure Osmometry following ASTM-2503, provided that the vapor pressure of the sample inside the Osmometer at 45° C. is less than the vapor pressure of toluene. For samples with vapor pressures greater than toluene, the molecular weight is preferably measured by benzene freezing point depression. Commercial instruments to measure molecular weight by freezing point depression are manufactured by Knauer. ASTM D2889 may be used to determine vapor pressure. Alternatively, molecular weight may be determined from a ASTM D-2887 or ASTM D-86 distillation by correlations which compare the boiling points of known n-paraffin standards.

The fraction of carbon atoms contributing to each branching type is based on the methyl resonances in the carbon NMR spectrum and uses a determination or estimation of the number of carbons per molecule. The area counts per carbon is determined by dividing the total carbon area by the number of carbons per molecule. Defining the area counts per carbon as "A", the contribution for the individual branching types is as follows, where each of the areas is divided by area A:

2–branches=half the area of methyls at 22.5 ppm/A

3–branches=either the area of 19.1 ppm or the area at 11.4 ppm (but not both)/A

4–branches=area of double peaks near 14.0 ppm/A

4+branches=area of 19.6 ppm/A minus the 4–branches internal ethyl branches=area of 10.8 ppm/A The total branches per molecule (i.e. the branching index) is the sum of areas above.

For this determination, the NMR spectrum is acquired under the following quantitative conditions: 45 degree pulse every 10.8 seconds, decoupler gated on during 0.8 sec acquisition. A decoupler duty cycle of 7.4% has been found to be low enough to keep unequal Overhauser effects from making a difference in resonance intensity.

In a specific example, the molecular weight of a Fischer Tropsch Diesel Fuel sample, based on the 50% point of 478° F. and the API gravity of 52.3, was calculated to be 240. For a paraffin with a chemical formula $C_nH_{2n+2}$, this molecular weight corresponds to an average number n of 17.

The NMR spectrum acquired as described above had the following characteristic areas:

2–branches=half the area of methyl at 22.5 ppm/A=0.30

3–branches=area of 19.1 ppm or 11.4 ppm not both/A=0.28

4–branches=area of double peaks near 14.0 ppm/A=0.32

4+branches=area of 19.6 ppm/A minus the 4–branches=0.14 internal ethyl branches=area of 10.8 ppm/A=0.21

The branching index of this sample was found to be 1.25.

"Branched-chain alkyl" means a branched saturated monovalent hydrocarbon radical of three to six carbon atoms, e.g. i-propyl, i-butyl, and the like.

"Cycloalkyl" means a saturated monovalent cyclic hydrocarbon radical of three to six ring carbons, e.g., cyclopropyl, cyclohexyl, and the like.

"Fischer-Tropsch derived products" mean any hydrocarbonaceous products derived from a Fischer Tropsch process. Fischer Tropsch derived products include, for example, Fischer Tropsch naphtha, Fischer Tropsch jet fuel, Fischer Tropsch diesel fuel, Fischer Tropsch solvent, Fischer Tropsch lube base stock, Fischer Tropsch lube base oil, Fischer Tropsch LPG, Fischer Tropsch synthetic crude, and mixtures thereof.

"Hydrocarbonaceous" means containing hydrogen and carbon atoms and potentially also containing heteroatoms, such as oxygen, sulfur, nitrogen, and the like.

"Hydrocarbonaceous Product" means any hydrocarbonaceous product, including both petroleum-derived hydrocarbonaceous products and Fischer Tropsch products. Hydrocarbonaceous products contain hydrogen and carbon atoms and may also contain heteroatoms, such as oxygen, sulfur, nitrogen, and the like.

"Paraffin" means any saturated hydrocarbon compound, i.e., an alkane, with the formula $C_nH_{2n+2}$.

"Petroleum-Derived Hydrocarbonaceous Product" means any hydrocarbonaceous product that is derived from crude oil or conventional petroleum products derived from crude oil. Petroleum-derived hydrocarbonaceous products contain greater than 1 ppm sulfur. Petroleum-derived hydrocarbonaceous products may be derived from, for example, conventional petroleum, conventional diesel fuel, conventional solvent, conventional jet fuel, conventional naphtha, conventional lube base stock, conventional lube base oil, and mixtures thereof.

"Sulfur-containing temporary antioxidant" means any temporary antioxidant that contains sulfur. Sulfur-containing temporary antioxidants include, for example, sulfides, disulfides, and the like.

"Sweetening-derived antioxidant" means any antioxidant derived from streams extracted from sweetening operations associated with light hydrocarbon desulfurization and sweetening process. These processes include, for example, the Merox process and the Extractive Merox process.

"Straight-chain alkyl" means a linear saturated monovalent hydrocarbon radical of one to six carbon atoms, e.g., methyl, ethyl, propyl, butyl, and the like.

"Temporary antioxidant" means any antioxidant that is more volatile than the Fischer Tropsch product such that it can be removed by processes such as simple distillation or stripping and the like. Temporary antioxidants are typically sulfur-containing compounds. Temporary antioxidants include, for example, sulfides, disulfides, polysulfides, and the like.

DETAILED DESCRIPTION OF ILLUSTRATIVE EMBODIMENTS

Hydrocarbonaceous products are typically stored or transported for a period of time before use. During storage and/or transport, hydrocarbonaceous products may be subject to conditions that promote oxidation. Oxidation during transport and storage and prior to use may cause many problems with ultimate use of the product. In particular, Fischer Tropsch products tend to oxidize relatively rapidly when exposed to air. The present invention relates to antioxidants that meet the increased need for effective antioxidants during shipment and storage of Fischer Tropsch products.

Fischer-Tropsch Process

Combustible liquid fuels can be prepared from natural gas through Fischer Tropsch processes. This preparation involves converting the natural gas, which is mostly methane, to synthesis gas, or syngas, which is a mixture of carbon monoxide and hydrogen.

Catalysts and conditions for performing Fischer-Tropsch synthesis are well known to those of skill in the art, and are described, for example, in EP 0 921 184 A1. In the Fischer-Tropsch synthesis process, liquid and gaseous hydrocarbons are formed by contacting a synthesis gas (syngas) comprising a mixture of $H_2$ and CO with a Fischer-Tropsch catalyst under suitable temperature and pressure reactive conditions. The Fischer-Tropsch reaction is typically conducted at temperatures of from about 300° to 700° F. (149° to 371° C.), preferably from about 400° to 550° F. (204° to 228° C.); pressures of from about 10 to 600 psia, (0.7 to 41 bars), preferably 30 to 300 psia, (2 to 21 bars) and catalyst space velocities of from about 100 to 10,000 cc/g/hr., preferably 300 to 3,000 cc/g/hr.

The products may range from $C_1$ to $C_{200+}$ with a majority in the $C_5$ to $C_{100+}$ range. The reaction can be conducted in a variety of reactor types, for example, fixed bed reactors containing one or more catalyst beds; slurry reactors; fluidized bed reactors; and a combination of different type reactors. Such reaction processes and reactors are well known and documented in the literature. Slurry Fischer-Tropsch processes, which is a preferred process in the practice of the invention, utilize superior heat (and mass) transfer characteristics for the strongly exothermic synthesis reaction and are able to produce relatively high molecular weight, paraffinic hydrocarbons when using a cobalt catalyst.

In a slurry process, a syngas comprising a mixture of $H_2$ and CO is bubbled up as a third phase through a slurry in a reactor which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to 4, but is more typically within the range of from about 0.7 to 2.75 and preferably from about 0.7 to 2.5. A particularly preferred Fischer-Tropsch process is taught in EP 0609079, incorporated herein by reference in its entirety.

Suitable Fischer-Tropsch catalysts comprise one or more Group VIII catalytic metals such as Fe, Ni, Co, Ru and Re. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Support materials including alumina, silica, magnesia and titania or mixtures thereof may be used. Preferred supports for cobalt containing catalysts comprise titania. Useful catalysts and their preparation are known and illustrative, but non-limiting examples may be found, for example, in U.S. Pat. No. 4,568,663.

A preferred Fischer Tropsch product of the present invention has a branching index of less than five, preferably less than four, more preferably less than three. Fischer-Tropsch derived products include, for example, Fischer Tropsch naphtha, Fischer Tropsch jet fuel, Fischer Tropsch diesel fuel, Fischer Tropsch solvent, Fischer Tropsch lube base stock, Fischer Tropsch lube base oil, Fischer Tropsch LPG, Fischer Tropsch synthetic crude, and mixtures thereof.

Fischer Tropsch distillate fuels also have excellent burning properties and are highly paraffinic. As a class, paraffins are the most biodegradable compounds found in petroleum and are preferentially metabolized by microbes. In Fischer Tropsch distillate fuels, paraffins are the majority components (>50%) and can exceed 70% and even 95%.

An advantage of using fuels prepared from syngas is that they do not contain nitrogen and sulfur and generally do not contain aromatic compounds. By way of example, Fischer Tropsch distillate fuels typically contain less than 1 ppm by weight sulfur. Accordingly, they may have minimal health and environmental impact. These Fischer-Tropsch-derived fuels are considered "green fuels" and are desirable as environmentally friendly.

Although sulfur is not environmentally desirable, it may act as a natural antioxidant in hydrocarbonaceous products, such as in petroleum-derived hydrocarbonaceous products, and inhibit oxidation during shipment and storage. Since Fischer Tropsch products contain essentially no sulfur or any other natural antioxidants, Fischer Tropsch products are prone to oxidize.

Antioxidants

The present invention relates to antioxidants that meet the increased need for effective antioxidants during shipment and storage of Fischer Tropsch products. The antioxidants of the present invention may also be effective for providing protection against oxidation without adding unwanted impurities to otherwise environmentally friendly Fischer Tropsch products.

The antioxidants of the present invention may be temporary antioxidants. The temporary antioxidants of the present invention may be added to the Fischer Tropsch products to provide protection against oxidation and may be removed from the Fischer Tropsch products when desired, for example, after the period in which oxidation is to be prevented and before use/sale of the products. The temporary antioxidants are added and blended into the Fischer Tropsch products and provide protection against oxidation during shipment and storage. After the period in which oxidation is to be prevented and before use/sale of the Fischer Tropsch products, the temporary antioxidants may be removed from the Fischer Tropsch products. Since the temporary antioxidants of the present invention are removed from the Fischer Tropsch products, the temporary antioxidants may not introduce unwanted impurities into the Fischer Tropsch products.

The temporary antioxidants of the present invention are typically sulfur-containing compounds. These sulfur-containing compounds may include compounds of the following Formula I:

$$RS_xR' \qquad \text{Formula I}$$

wherein R and R' are independently straight chain alkyl, branched alkyl, or cycloalkyl and x is an integer from 1 to 4, preferably 1 to 3. For example, these sulfur-containing compounds may be sulfides, disulfides, polysulfides, and mixtures thereof. Preferably, the temporary antioxidants of the present invention are disulfides. Sulfides and disulfides are effective antioxidants and may provide excellent oxidative protection for readily oxidizable products. See *Chemical Technology of Petroleum*, by Gruse and Stevens, 3rd Edition, 1960, page 299.

The compounds of Formula I may be removable from the Fischer Tropsch process when desired. As well as being able to be removed, an added advantage of the compounds of Formula I is that they are relatively non-corrosive, sulfur-containing compounds. Therefore, corrosion of storage vessels, as tends to occur when mercaptans (RSH) are used, may be avoided.

The temporary antioxidants of the present invention are more volatile than the Fischer Tropsch derived products of the present invention. The temporary antioxidants preferably have a mid boiling point, at least 10° F. lower than the 5% point of the Fischer Tropsch product (as determined by ASTM D-2887), more preferably 20° F. lower, and most preferably 50° F. lower, and thus, they are more volatile than the Fischer Tropsch products. Accordingly, the temporary antioxidants of the present invention typically have a boiling point range of from 37° C. (dimethyl sulfide) to 180° C., preferably 110° C. (dimethyldisulfide) to 150° C., and more preferably 110° C. to 125° C. The most preferred temporary anti-oxidants of the present invention contain dimethyldisulfide.

The temporary antioxidants of the present invention are preferably lighter materials than the antioxidants that may be obtained from gas field condensate, virgin distillate, or hydrotreated streams. Antioxidants obtained from the above-listed sources can be expected to contain materials that boil above about 180° C., and thus will typically boil within the boiling range of the fuel. Therefore, antioxidants obtained from the above-listed sources may not qualify as temporary antioxidants of the present invention.

Since the temporary antioxidants of the present invention are lighter (i.e., more volatile) than the Fischer Tropsch derived products, they may be readily removed from the Fischer Tropsch products when desired. The preferred temporary antioxidants may be removed easily by distillation or stripping when the product is ready for sale and/or use or when the danger of oxidation has ended.

The temporary antioxidants of the present invention are typically sulfur-containing compounds derived from petroleum products. For example, the temporary antioxidants of the present invention may be derived from light streams in the gas or crude collection process. For example, temporary antioxidants of the present invention may be derived from light streams in Fischer Tropsch processes.

A ready source of the relatively non-corrosive, temporary antioxidants of the present invention is the extracted stream from sweetening operations associated with the light hydrocarbon desulfurization and sweetening processes ("sweetening-derived antioxidants"). Petroleum streams typically contain mercaptans and hydrogen sulfide. Before use of these petroleum streams, it is desirable to remove the mercaptans and hydrogen sulfide. A review of traditional methods of removing mercaptans and hydrogen sulfide from petroleum streams is as described in *Chemical Technology of Petroleum*, William A. Gruse and Donald R. Stevens, 3rd Edition, McGraw-Hill Book Company, Inc. pages 301–304.

Mercaptans are commonly removed by a "sweetening" or "extractive sweetening" process. This type of process generally involves reacting the mercaptans (RSH) in a hydrocarbon stream (either gas or liquid) with caustic solutions (NaOH) to form water and mercaptides (NaSR). The mercaptides are partitioned in the aqueous caustic phase, and are separated from the hydrocarbon stream by density differences. The mercaptide-containing caustic phase is then oxidized, usually with air, and sometimes with the assistance of a catalyst to form disulfides (RSSR'), which regenerates the caustic. Disulfides and sulfides are examples of sulfur-containing compounds generated by sweetening processes performed on light hydrocarbon streams. The disulfides are for the most part immissible in the caustic, and can be separated by density differences or by dissolving them in a hydrocarbon stream. The disulfides can be disposed of, blended with the original product stream, or, as in the present invention, blended with a Fischer Tropsch product. Since disulfides do not contain a —SH functional group found in mercaptans, they are less corrosive and toxic, hence the name "sweetening" for the overall process.

The oxidation of the mercaptides to disulfides and regeneration of the caustic can be done with a variety of oxidants (air, pure oxygen, enriched air, chemical oxidants such as hydrogen peroxide) or mixtures thereof. However, air is the most commonly used oxidant because of its low cost. The oxidation of mercaptides to disulfides can be done without a catalyst, but the reaction tends to be slow. It is generally preferred to incorporate a catalyst to accelerate the oxidation of the mercaptides. These catalysts are typically metals, and the most common metals are lead (typically PbS), copper (typically as a copper chloride), or a phthalocyanine complex of copper, iron, nickel or cobalt, preferably cobalt. The preparation and use of phthalocyanine complexes for mercaptide oxidation is described in, for example, U.S. Pat. No. 5,880,279 to Mazgarov et al.

A specific source of sweetening of light hydrocarbons to provide the relatively non-corrosive, temporary antioxidants of the present invention is extracted streams from the gas asset of the Fischer Tropsch process. The gas asset is used to provide methane and other light hydrocarbons as feedstocks for the Fischer Tropsch process. The hydrocarbon streams of the gas asset may contain impurities such as mercaptans. Before use in the Fischer Tropsch process, the asset gas is cleaned to remove impurities. This cleaning process may involve sweetening processes, forming disulfides from the mercaptans.

In addition to being readily removable and non-corrosive, the temporary antioxidants of the present invention are efficient and economical to utilize. Temporary antioxidants derived from sweetening light hydrocarbon streams may be produced at or near (within 100 miles) of the usually remote site where Fischer Tropsch products are generated. Thus, the temporary antioxidants do not have to be purchased from a third party, do not have to be generated at a remote location (over 100 miles away), do not have to be shipped from a remote location, and are already being produced in the petroleum refinery process. Therefore, use of the temporary antioxidants of the present invention is efficient and economical.

As one of skill in the art would readily understand and be able to devise, the antioxidant may be added and blended into the Fischer Tropsch product in a variety of ways. By way of example, the antioxidant and Fischer Tropsch product may be mixed and then pumped into a storage or transportation device. The antioxidant may be dissolved into the Fischer Tropsch product directly from a sweetening process. In addition, the antioxidant may be added to an empty storage or transportation device and then the Fischer Tropsch product may be added with agitation.

An effective amount of a temporary antioxidant of the present invention is the amount that provides a product having a final peroxide number of less than 5 ppm, preferably less than 3 ppm, and most preferably less than 1 ppm after 7 days. The blended product is tested for stability according to standard procedures for measuring the buildup of peroxides according to ASTM D3703-99. ASTM D3703-99 covers the determination of peroxide content of aviation-turbine fuels. ASTM D3703-99 describes a procedure by which the peroxide number expressed as mg of peroxide/kg of sample is determined. In this procedure, a quantity of sample is dissolved in 1,1,2-trichloro-1,2,2-trifluoroethane. This solution is contacted with aqueous potassium iodide solution. The peroxides present are reduced by the potassium iodide. An equivalent amount of iodine is liberated, which is titrated with sodium thiosulfate solution. The results are calculated as milligrams of peroxide per kilogram of sample. The formation of peroxides indicates the onset of oxidation and provides a measure of oxidative stability.

The effective amount may vary, but is generally added in a concentration of between 1 ppm and 1 wt %. Preferably, the temporary antioxidant may be added at a concentration of between 10 ppm and 1000 ppm. Preferably, the sulfur-containing temporary antioxidant is added such that the sulfur content of the resulting blended product is greater than 1 ppm.

The formation of peroxides in the sample should be evaluated under conditions similar to the intended transportation or storage conditions. Materials are typically transported or stored as liquids, and should be tested as such. For materials that have pour points below 25° C., the test temperature is 25° C. For materials that have pour points of 25° C. or higher, the test temperature is 110° C. above the pour point. Pour points are measured by ASTM D 97. Sufficient sample to perform the test is place in an open wide mouth bottle and placed in contact with air in an oven maintained at the test temperature for the duration of the test. The sample is removed and portions analyzed for peroxide number, while the remainder of the sample is returned to the oven.

Samples that show an initial high level of peroxide (above 5 ppm) have already been oxidized. These samples should be purified by contact with an adsorbent (alumina) to reduce their initial peroxide number to below 1 prior to performing the oxidation experiments.

The use of sulfur-containing antioxidants increases the sulfur content of low sulfur, environmentally friendly Fischer Tropsch fuels, and thus may defeat one of Fischer Tropsch fuels most desirable characteristics (i.e., low sulfur content) and prevent their use as green fuels. Therefore, once the Fischer Tropsch products have been transported or stored and are ready for use or are no longer in danger of oxidation, it is desirable to remove the temporary antioxidants such that the final Fischer Tropsch product will retain its desirable, low-sulfur content. The temporary antioxidants of the present invention may be readily removed from the Fischer Tropsch products.

As one of skill in the art would understand, the temporary antioxidant may be removed from the Fischer Tropsch products by any number of processes, including, for example, distillation or steam stripping, water washing, caustic washing, adsorption onto a solid support, mild hydrotreating, and the like. By way of example, extraction with a caustic solution may be performed as in Extractive Merox. Further, adsorption onto a solid support may be accomplished in a refinery or storage facility, or in a vehicle just prior to use. Preferably, the temporary antioxidants are removed by simple distillation or stripping. Preferably, at least a portion of the temporary antioxidants are removed by one of the above processes such that the final product may have a sulfur content of less than 100 ppm, preferably less than 10 ppm and most preferably less than 1 ppm.

If necessary, after the temporary antioxidant is removed to provide a salable product, a conventional antioxidant may be incorporated into the salable product if necessary. By way of example, in the case of a Fischer Tropsch lube base oil, once the temporary antioxidant is removed, conventional antioxidants in the additive package can be incorporated to provide antioxidant protection in a salable product. As one of skill in the art would readily understand, similar procedures may be used for Fischer Tropsch diesel fuel and other Fischer Tropsch products.

Methods of inhibiting Oxidation

The present invention also relates to methods of inhibiting oxidation of a Fischer Tropsch product. One method comprises synthesizing a Fischer Tropsch product by a Fischer Tropsch process. The product recovered from a Fischer-Tropsch process may range from $C_5$ to $C_{20+}$and may be distributed in one or more product fractions. In the Fischer Tropsch process, the desired Fischer Tropsch product typically will be isolated by distillation.

The products from Fischer-Tropsch reactions performed in slurry bed reactors generally include a light reaction product and a waxy reaction product. The light reaction product (i.e. the condensate fraction) includes hydrocarbons boiling below about 700° F. (e.g., tail gases through middle distillates), largely in the $C_5$–$C_{20}$ range, with decreasing amounts up to about $C_{30}$. The waxy reaction product (i.e. the wax fraction) includes hydrocarbons boiling above 600° F. (e.g., vacuum gas oil through heavy paraffins), largely in the $C_{20}$+range, with decreasing amounts down to $C_{10}$. Both the light reaction product and the waxy product are substantially paraffinic. The waxy product generally comprises greater than 70% normal paraffins, and often greater than 80% normal paraffins. The light reaction product comprises paraffinic products with a significant proportion of alcohols and olefins. In some cases, the light reaction product may comprise as much as 50%, and even higher, alcohols and olefins.

The product from the Fischer-Tropsch process may be further processed using, for example, hydrocracking, hydroisomerization, hydrotreating. Such processes crack the larger synthesized molecules into fuel range and lube range molecules with more desirable boiling points, pour points, and viscosity index properties. Such processes may also saturate oxygenates and olefins to meet the particular needs of a refiner. These processes are well known in the art and do not require further description here.

To the Fischer Tropsch product is added an effective amount of a temporary antioxidant to provide a product having a final peroxide number of less than 5 ppm, preferably less than 3 ppm, and most preferably less than 1 ppm after 7 days. The temporary antioxidant is mixed into the Fischer Tropsch product to provide a blended product.

As one of skill in the art would readily understand and be able to devise, the temporary antioxidant may be added and blended into the Fischer Tropsch product in a variety of ways. By way of example, the temporary antioxidant and Fischer Tropsch product may be mixed and then pumped into a storage or transportation device. The temporary antioxidant may be dissolved into the Fischer Tropsch product directly from a sweetening process. In addition, the temporary antioxidant may be added to an empty storage or transportation device and then the Fischer Tropsch product may be added with agitation.

An effective amount of temporary antioxidant to be mixed is the amount that inhibits oxidation sufficiently such that a blended product having a final peroxide number of less than 5 ppm, preferably less than 3 ppm and most preferably less than 1 ppm after 7 days is provided. The blended product is tested for stability according to standard procedures for measuring the buildup of peroxides according to ASTM D3703-99, as described previously. The formation of peroxides indicates the onset of oxidation and provides a measure of oxidative stability.

After the period in which oxidation is to be inhibited, at least a portion of the temporary antioxidant is removed. The step of removing the temporary antioxidant may be accomplished by any number of processes, including, for example, distillation or steam stripping, water washing, caustic washing, adsorption onto a solid support, and the like. Preferably, the step involves simple distillation or stripping.

The method of the present invention may also comprise the step of generating the temporary antioxidant by sweetening light hydrocarbon streams. To generate the temporary antioxidants, a hydrocarbon stream containing mercaptans may be contacted with caustic to form mercaptides. The mercaptides may be oxidized to form disulfides, which are stripped from the caustic by distillation or steam stripping. These disulfides may be added to the Fischer Tropsch product. Since the disulfides will be more soluble in the Fischer Tropsch product than in the caustic, they can be transferred to the Fischer Tropsch product by simply contacting the two streams and then separating them by density differences. The preferred starting mercaptans are (methyl) mercaptan and (ethyl)mercaptan, with (methyl)mercaptan being particularly preferred.

The light streams in the gas or crude collection process or the gas asset of the Fischer Tropsch process may also be used as the hydrocarbon streams containing mercaptans. As described above, cleaning of these hydrocarbon streams to remove impurities, such as mercaptans, may provide the temporary antioxidants for the Fischer Tropsch products.

The temporary antioxidant of the present invention may be selected from the group consisting of sulfides, disulfides, and polysulfides.

In another method of the present invention, a Fischer Tropsch product is synthesized in a Fischer Tropsch process. The product recovered from a Fischer-Tropsch process may range from $C_5$ to $C_{20+}$ and may be distributed in one or more product fractions. In the Fischer Tropsch process, the desired Fischer Tropsch product typically will be isolated by distillation.

To the Fischer Tropsch product is added an effective amount of an antioxidant to provide a product having a final peroxide number of less than 5 ppm, preferably less than 3 ppm, and most preferably less than 1 ppm after 7 days. The antioxidant is mixed into the Fischer Tropsch product to provide a blended product. As one of skill in the art would readily understand and be able to devise, the antioxidant may be added and mixed into the Fischer Tropsch product in a variety of ways. By way of example, the antioxidant and Fischer Tropsch product may be mixed and then pumped into a storage or transportation device. The antioxidant may be dissolved into the Fischer Tropsch product directly from a sweetening process. In addition, the antioxidant may be added to an empty storage or transportation device and then the Fischer Tropsch product may be added with agitation.

After the period in which oxidation is to be inhibited, at least a portion of the antioxidant is removed. The step of removing the antioxidant may be accomplished by any number of processes, depending on the type of antioxidant used. The step of removing the antioxidant may be accomplished by, for example, distillation or steam stripping, water washing, caustic washing, adsorption onto a solid support, processing with hydrogen (hydrotreating, hydrocracking, hydroisomerization), and the like.

In this embodiment, the antioxidants may be any appropriate antioxidant including the temporary antioxidants of the present invention and antioxidants that have about the same boiling range as the Fischer Tropsch product. Preferably, the antioxidant is a sulfur-containing compound and may be selected from the group consisting of sulfides, disulfides, polysulfides, mercaptans, and the like. The antioxidant in this method of the present invention may be a mercaptan because this method may include the step of processing the blended product with hydrogen to remove at least a portion of the sulfur after the period in which oxidation is expected. Although the antioxidant may be a mercaptan, it is preferred that the antioxidant be a compound other than a mercaptan.

If the antioxidant boils within the same range as the Fischer Tropsch product, it may be removed by any number of processes, including, for example, adsorption onto a solid support, extraction, processing with hydrogen, and the like. The preferred processes for removing sulfur from antioxidants that boil within the same range as the Fischer Tropsch product include those involving processing with hydrogen (i.e., hydrotreating, hydrocracking, and hydroisomerization), with hydrotreating being the most preferred.

Hydrotreating is a process for removing impurities, such as heteroatoms (i.e. sulfur, nitrogen, oxygen) or compounds containing sulfur, nitrogen, or oxygen, from a hydrocarbon product mixture. Typical hydrotreating conditions vary over a wide range. In general, the overall LHSV (Liquid Hourly Space Velocity) is about 0.25 to 2.0 $hr^{-1}$, preferably about 0.5 to 1.0 $hr^{-1}$. The hydrogen partial pressure is greater than 200 psia, preferably ranging from about 500 psia to about 2000 psia. Hydrogen re-circulation rates are typically greater than 50 SCF/Bb1, and are preferably between 1000 and 5000 SCF/Bb1. Temperatures range from about 300° F. to about 750° F., preferably ranging from 450° F. to 600° F.

In the method of the present invention, the blended product is processed as described above to remove at least a portion of the sulfur, such that the resulting final product may have a sulfur content of less than 100 ppm, preferably less than 10 ppm and most preferably less than 1 ppm. The resulting product may be used as an environmentally friendly green fuel.

In an additional method of the present invention, a Fischer Tropsch product is synthesized in a Fischer Tropsch process. The product recovered from a Fischer-Tropsch process may range from $C_5$ to $C_{20+}$ and may be distributed in one or more product fractions. In the Fischer Tropsch process, the desired Fischer Tropsch product typically will be isolated by distillation.

To the Fischer Tropsch product is added an amount of an effective amount of a sulfur-containing temporary antioxidant to provide a blended product containing greater than 1 ppm sulfur. The sulfur-containing temporary antioxidant is mixed into the Fischer Tropsch product to provide a blended product. As one of skill in the art would readily understand and be able to devise, the sulfur-containing temporary antioxidant may be added and mixed into the Fischer Tropsch product in a variety of ways. By way of example, the sulfur-containing antioxidant and Fischer Tropsch product may be mixed and then pumped into a storage or transportation device. The sulfur-containing antioxidant may be dissolved into the Fischer Tropsch product directly from a sweetening process. In addition, the sulfur-containing antioxidant may be added to an empty storage or transportation device and then the Fischer Tropsch product may be added with agitation.

After the period in which oxidation is to be inhibited, at least a portion of the sulfur-containing temporary antioxidant is removed to provide a final product with a sulfur content of less than 100 ppm, preferably less than 10 ppm, and most preferably less than 1 ppm. The step of removing the sulfur-containing temporary antioxidant may be accomplished by any number of processes, including, for example, distillation or steam stripping, water washing, caustic washing, adsorption onto a solid support, and the like. Preferably, the step involves simple distillation or stripping.

The sulfur-containing temporary antioxidant of the present invention may be selected from the group consisting of sulfides, disulfides, and polysulfides. This method of the present invention may also comprise the step of generating the sulfur-containing temporary antioxidant by sweetening light hydrocarbon streams.

EXAMPLES

The invention will be further explained by the following illustrative examples that are intended to be non-limiting.

Example 1

A hydrocarbon raw material stream at a remote site is obtained from an underground reservoir. The stream is separated into a gaseous product and a liquid product (crude oil). The gaseous product contains sulfur compounds and in particular mercaptans. The mercaptans in the gaseous product are removed by caustic, converted to disulfides by oxidation, and separated from the caustic. The purified gas stream is converted to synthesis gas and further converted to heavier hydrocarbon products by use of the Fischer Tropsch process. The products from the Fischer Tropsch process are blended with the recovered disulfides to form an oxidation-resistant product. Typically this blended product contains more than 1 ppm sulfur in the form of disulfides. The oxidation-resistant product is then shipped to a developed site where the disulfides are separated from the Fischer Tropsch product by distillation.

Example 2

A hydrocarbon raw material stream at a remote site is obtained from an underground reservoir. The stream is separated into a gaseous product and a liquid product (crude oil). The gaseous product contains sulfur compounds and in particular mercaptans. The crude oil also contains sulfur. The mercaptans in the gaseous product are removed by caustic, converted to disulfides by oxidation, and separated from the caustic and discarded. The purified gas stream is converted to synthesis gas and further converted to heavier hydrocarbon products by use of the Fischer Tropsch process. The products from the Fischer Tropsch process are blended with the recovered crude oil (or product derived from the recovered crude oil, e.g. diesel) to form an oxidation-resistant blended product. Typically this blended product contains more than 1 ppm sulfur. The blended product is then shipped to a developed site where the sulfur compounds are removed by hydrotreating. The hydrotreating converts the sulfur compounds into hydrogen sulfide, which is separated from the blended product by distillation.

What is claimed is:

1. A blended hydrocarbonaceous product comprising:

a) a Fischer Tropsch derived product; and b) an effective amount of a temporary antioxidant such that the blended product has a peroxide number of less than 5 ppm after 7 days, wherein the temporary antioxidant is the only antioxidant present in an effective amount in the blended hydrocarbonaceous product.

2. A blended hydrocarbonaceous product according to claim 1, wherein the blended product has a peroxide number of less than 3 ppm after 7 days.

3. A blended hydrocarbonaceous product according to claim 1, wherein the blended product has a peroxide number of less than 1 ppm after 7 days.

4. A blended hydrocarbonaceous product according to claim 1, wherein the Fischer Tropsch derived product is selected from the group consisting of Fischer Tropsch naphtha, Fischer Tropsch jet fuel, Fischer Tropsch diesel fuel, Fischer Tropsch solvent, Fischer Tropsch lube base stock, Fischer Tropsch lube base oil, Fischer Tropsch LPG, Fischer Tropsch synthetic crude, and mixtures thereof.

5. A blended hydrocarbonaceous product according to claim 1, wherein the temporary antioxidant has a mid-boiling point at least 10° F. lower than the 5% point of the Fischer Tropsch product.

6. A blended hydrocarbonaceous product according to claim 5, wherein the temporary antioxidant has a mid-boiling point at least 20° F. lower than the 5% point of the Fischer Tropsch product.

7. A blended hydrocarbonaceous product according to claim 6, wherein the temporary antioxidant has a mid-boiling point at least 50° F. lower than the 5% point of the Fischer Tropsch product.

8. A blended hydrocarbonaceous product according to claim 1, wherein the temporary antioxidant is a sulfur-containing antioxidant.

9. A blended hydrocarbonaceous product according to claim 8, wherein the sulfur-containing antioxidant is a compound of Formula I $$RS_xR' \qquad \text{Formula I}$$

wherein R and R' are independently selected from the group consisting of straight chain alkyl, branched alkyl, and cycloalkyl; and x is an integer from 1 to 4.

10. A blended hydrocarbonaceous product according to claim 9, wherein R and R' are independently selected from the group consisting of methyl, ethyl, propyl, n-butyl, and i-butyl; and x is 2 or 3.

11. A blended hydrocarbonaceous product according to claim 9, wherein x is 2.

12. A blended hydrocarbonaceous product according to claim 9, wherein the blended product contains between 1 ppm to 1 wt % antioxidant.

13. A blended hydrocarbonaceous product according to claim 12, wherein the antioxidant is selected from the group consisting of dimethyldisulfide, methylethyldisulfide, diethyldisulfide, and mixtures thereof.

14. A blended hydrocarbonaceous product according to claim 9, wherein the antioxidant is a sweetening-derived antioxidant.

15. A blended hydrocarbonaceous product comprising:

a) a Fischer Tropsch derived product; and b) an effective amount of a sulfur-containing temporary antioxidant, wherein the sulfur-containing temporary antioxidant is the only antioxidant present in an effective amount in the blended hydrocarbonaceous product and further wherein the sulfur content of the blended hydrocarbonaceous product is $\geqq 1$ ppm.

16. A blended hydrocarbonaceous product according to claim 15, wherein the sulfur-containing antioxidant is a compound of Formula I $$RS_xR' \qquad \text{Formula I}$$

wherein R and R' are independently selected from the group consisting of straight chain alkyl, branched alkyl, and cycloalkyl; and x is an integer from 1 to 4.

17. A blended hydrocarbonaceous product according to claim 16, wherein R and R' are independently selected from the group consisting of methy, ethyl, propyl, n-butyl, and i-butyl; and x is 2 or 3.

18. A blended hydrocarbonaceous product according to claim 16, wherein x is 2.

19. A blended hydrocarbonaceous product according to claim 16, wherein the blended product contains between 1 ppm to 1 wt % antioxidant.

20. A blended hydrocarbonaceous product according to claim 15, wherein the temporary antioxidant has a mid-boiling point at least 10° F. lower than the 5% point of the Fischer Tropsch product.

21. A blended hydrocarbonaceous product according to claim 20, wherein the temporary antioxidant has a mid-boiling point at least 20° F. lower than the 5% point of the Fischer Tropsch product.

22. A blended hydrocarbonaceous product according to claim 21, wherein the temporary antioxidant has a mid-boiling point at least 50° F. lower than the 5% point of the Fischer Tropsch product.

* * * * *